US005269470A

United States Patent [19]

Ishikawa et al.

[11] Patent Number: 5,269,470

[45] Date of Patent: Dec. 14, 1993

[54] METHOD OF PRODUCING FINELY DIVIDED FIBROUS CELLULOSE PARTICLES

[75] Inventors: Hisao Ishikawa, Tokyo; Seiichi Ide, Ichikawa, both of Japan

[73] Assignee: Oji Paper Co., Ltd., Tokyo, Japan

[21] Appl. No.: 935,998

[22] Filed: Aug. 27, 1992

[30] Foreign Application Priority Data

Oct. 1, 1991 [JP] Japan ..... 3-253804

[51] Int. Cl.[5] ..... B02C 21/00

[52] U.S. Cl. ..... 241/21; 241/23; 241/30

[58] Field of Search ..... 241/17, 21, 23, 30, 241/171, 172

[56] References Cited

U.S. PATENT DOCUMENTS 4,374,702 2/1983 Turbak et al. .
4,483,743 11/1984 Turbak et al. .
4,550,033 10/1985 Boutin ..... 241/6 X
5,028,229 7/1991 Guidat et al. ..... 241/28 X
5,087,400 2/1992 Theuveny ..... 241/28 X

FOREIGN PATENT DOCUMENTS 57-14771 3/1982 Japan .
59-120638 7/1984 Japan .
1543274 3/1979 United Kingdom .

*Primary Examiner*—Mark Rosenbaum
*Assistant Examiner*—Frances Chin
*Attorney, Agent, or Firm*—Armstrong, Westerman, Hattori, McLeland & Naughton

[57] ABSTRACT

Finely divided fibrous cellulose particles having a high viscosity, suspension stability and water-retaining property are produced by suspending cellulose particles in water or an organic liquid, and subjecting the resultant cellulose particle slurry to a wet grinding procedure in a solid medium-agitation type grinder in which the cellulose particles are agitated and ground with solid medium particles, for example, glass beads, to an extent such that the cellulose particles are divided into fine fibrous cellulose particles having a water-retaining power WRP of 150% or more in accordance with an equation (I):

$$WRP(\%)=(A-B)/B\times 100 \quad (I)$$

wherein A represents the weight of a sample of the resultant cellulose particle suspension centrifugally hydroextracted at an acceleration of 3,000 G for 15 minutes, and B represents the weight of the sample dried at 105° C. for 5 hours or more.

9 Claims, 3 Drawing Sheets

METHOD OF PRODUCING FINELY DIVIDED FIBROUS CELLULOSE PARTICLES

BACKGROUND OF THE INVENTION

1. Field of the Invention

The present invention relates to a method of producing finely divided fibrous cellulose particles.

More particularly, the present invention relates to a method of producing finely divided fibrous cellulose particles capable of forming an aqueous suspension thereof having a high viscosity and a high suspension stability even in a relatively low consistency.

2. Description of the Related Arts

It is known that fine fibrous particles produced by finely grinding cellulose particles have a large surface area, a high affinity to water, a high water-retaining power and a high capability of forming an aqueous suspension thereof having a high viscosity even in a low consistency thereof and excellent suspension stability, and therefore are useful as a humectant, dispersant, and thickener.

Also, it is known to produce fine cellulose particles having a large surface area by mechanically grinding cellulose fibers. In this conventional method, the cellulose fibers are coarsely divided by a roll crusher or a course crushing cutter and then finely divided by a rotary type mill known as a high speed impact crusher.

As commercially available cellulose particles produced by the mechanical grinding, Pulp Flock (a trademark, produced by Sanyokokusaku Pulp Co.) produced from parenchyma cells having a low mechanical strength, or Cellulose Powder B (a trademark, produced by Lettenmayer Brother Co.) are known.

Nevertheless, since the cellulose fibers are of a soft organic substance, it is difficult to produce satisfactorily finely divided cellulose particles by a mechanical grinding operation alone. Therefore, a method comprising a combination of a chemical dividing step and a mechanical dividing step is usually employed to obtain fine cellulose particles. Generally, the cellulose fibers are composed mainly of crystalline segments and amorphous segments and the amorphous segments are more reactive to reactants than the crystalline segments. This specific property of the cellulose fibers is utilized to provide the finely divided cellulose fibers in the conventional chemical dividing method. Namely, in this chemical method, the cellulose fibers are subjected to a reaction with a mineral acid, for example, to selectively dissolve away the amorphous segments and maintain the crystalline segments. By this chemical method, fine crystalline cellulose particles consisting mainly of crystalline segments are obtained.

In another known method, a light chemical treatment is applied to the cellulose fibers to reduce the mechanical strength of the cellulose fibers, and then the resultant chemically treated cellulose fibers are crushed by a mechanical treatment. This method is a combination of the chemical treatment and the mechanical grinding treatment, and disclosed in "Japanese Journal of Paper Technology" No. 8, pages 5 to 11, 1985, August.

The fine cellulose particles produced by the above-mentioned conventional method are widely used, and have various applications, for example, filtration assistance, rubber filler, excipient for medical tablet, suspension-stabilizer, thickener and shape-retaining agent.

Where the conventional fine cellulose particles are used as a suspension-stabilizer, thickener or shape-retaining agent in which the suspension-thicking effect, dispersion-stabilizing effect and gel-forming effect of the conventional fine cellulose particles are utilized, it is necessary to employ the conventional fine cellulose particles in a high consistency or in a large amount, because of the low affinity of the conventional cellulose particles to water. The increase in the amount of the fine cellulose particles used results in an economic disadvantage. Particularly, when used for foods, the increase in the content of the cellulose particles in the food results in a disadvantage in that the resultant food is rough and unpleasant to the touch.

To eliminate the above-mentioned disadvantage, Japanese Examined Patent Publication (JP-B) No. 57-14,771 discloses fine crystalline cellulose particles coated on the surfaces thereof with a water-soluble high molecular substance for food use. The coated cellulose particles are also disadvantageous in the high moisture-absorbing properies thereof, high rotting properties thereof when dispersed in water, or a significant reduction in viscosity thereof when heated.

It is known that the aqueous suspension of the fine crystalline cellulose particles can be homogenized by extruding the aqueous suspension of the fine crystalline cellulose particles through an orifice having a small inside diameter under a pressure of at least 200 kg/cm$^2$ to impart a high velocity to the suspension, and striking the stream of the suspension against a hard face to rapidly reduce the velocity and applying shearing and cutting actions to the cellulose particles. When the above-mentioned steps are repeatedly applied, the suspension stability of the fine cellulose particles in water is enhanced. The resultant aqueous suspension of the fine crystalline cellulose particles exhibits enhanced suspension stability and high viscosity even in a very low solid consistency thereof. This method is disclosed in Japanese Unexamined Patent Publication (JP-A) No. 59-120,638.

Also, U.S. Pat. Nos. 4,374,702 and 4,483,743 disclose a method of preparing microfibrillated cellulose, in which an aqueous suspension of fibrous cellulose is homogenized by extruding the suspension through a small diameter orifice so that the suspension is subjected to a pressure drop of at least 3000 psi and a high velocity shearing action followed by a high velocity deceleration impact against a solid surface However, these high pressure homogenizing methods are disadvantageous in that the extrusion operation of the aqueous cellulose particle suspension through a thin orifice under high pressure must be repeated, and thus the treatment efficiency is low and the cost is high.

Accordingly, there is a strong demand for providing a method of producing finely divided fibrous cellulose particles capable of forming a highly stable aqueous suspension thereof having high viscosity even in a low consistency, and high production efficiency.

SUMMARY OF THE INVENTION

An object of the present invention is to provide a method of producing finely divided fibrous cellulose particles capable of forming a highly stable aqueous suspension thereof having a high viscosity even in a low consistency, and with a high efficiency, by finely grinding coarse cellulose particles.

The above-mentioned object can be attained by the method of the present invention of producing finely divided fibrous cellulose particles, comprising the steps of:

suspending cellulose particles in water to provide an aqueous cellulose particle slurry, treating the aqueous cellulose particle slurry in a solid medium-agitation type grinder in which the cellulose particles are agitated and ground with solid medium beads to an extent such that the cellulose particles are finely divided into fine fibrous cellulose particles having a water-retaining power of 150% or more, determined by centrifugally hydroextracting a sample of the resultant aqueous slurry of the finely divided fibrous cellulose particles at an acceleration of 3000 G for 15 minutes, measuring the weight of the hydroextracted sample, drying the hydroextracted sample at a temperature of 105° C. for 5 hours or more, measuring the weight of the dried sample, and calculating the water-retaining power of the finely divided fibrous cellulose particles in the sample, in accordance with the equation (I):

$$WRP\ \% = \frac{A - B}{B} \times 100 \quad \text{(I)}$$

wherein WRP represents the water-retaining power of the finely divided fibrous cellulose particles in the samples; A represents the weight of the hydroextracted sample, and B represents the weight of the dried sample.

In the method of the present invention, the resultant finely divided fibrous cellulose particles preferably exhibit a viscosity of 50 cP or more in a 2 weight % aqueous suspension thereof and a suspension stability of 50% or more in a 0.5 weight % aqueous suspension thereof, determined by placing the 0.5 weight % aqueous suspension in a 500 ml measuring cylinder, leaving the aqueous suspension to stand at a temperature of 20° C. for one hour to allow the finely divided fibrous cellulose particles to settle, and calculating the suspension stability of the finely divided fibrous cellulose particles in accordance with the equation (II):

$$SS(\%) = V/V_0 \times 100 \quad \text{(II)}$$

wherein SS represents the suspension stability of the finely divided fibrous cellulose particles in the aqueous suspension; $V_0$ represents an initial volume of the upper level of the original aqueous suspension in the measuring cylinder, and V represents the volume of an upper level on and under which the finely divided fibrous cellulose particles are still suspended just after the one hour-leaving step.

DESCRIPTION OF PREFERRED EMBODIMENTS

Figure 1:
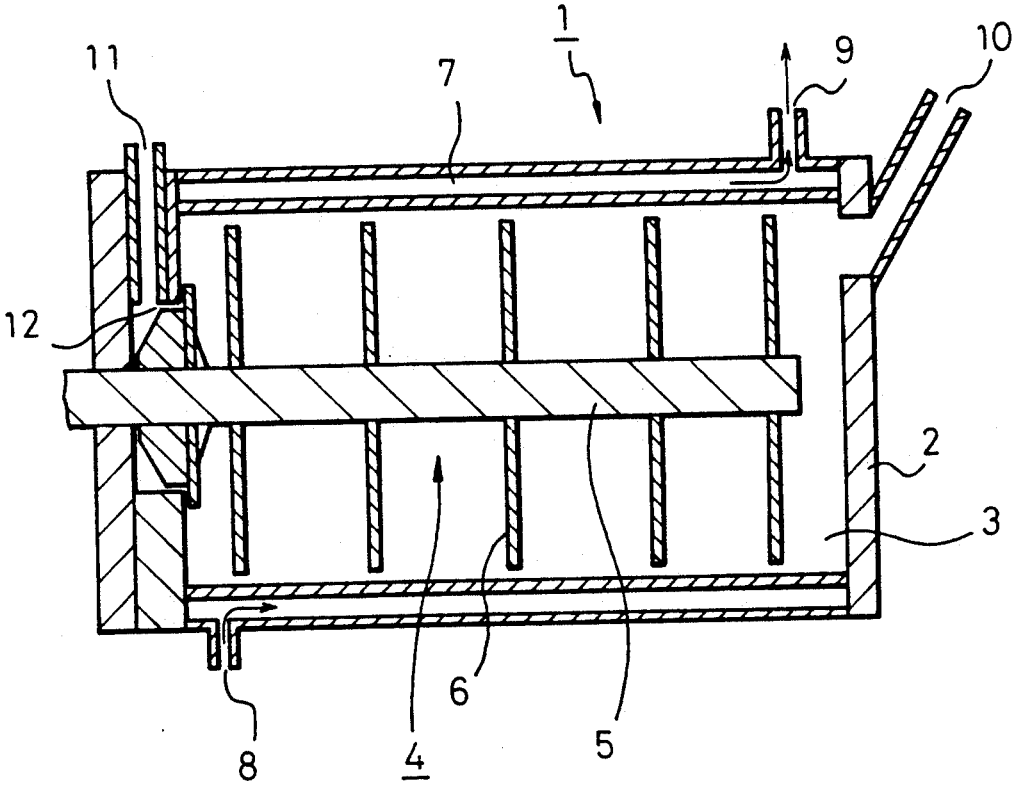
FIG. 1 is a cross-sectional profile of a Dyno mill, which is a typical solid medium agitation type grinder usable for the method of the present invention.

The inventors of the present invention expected that an aqueous suspension of cellulose particles having a high viscosity even in a low consistency thereof, can be obtained by finely dividing the cellulose particles into fine fibrous particles to increase the specific surface area of the cellulose particles and enhance the affinity of the cellulose particles to water. In this expectation, the inventors studied a wet grinding method of the cellulose particles and discovered that when the wet grinding method is carried out by using a solid medium agitation type grinder, the cellulose particles can be finely divided into fine fibrous particles with a very high efficiency, and the resultant finely divided fibrous cellulose particles exhibit excellent suspension stability, high viscosity and high water-retaining power. This invention was completed based on this discovery.

In the method of the present invention for producing finely divided fibrous cellulose particles, a cellulose particle slurry is prepared by suspending cellulose particles in a liquid not chemically reactive to the cellulose particles, for example, water, and subjected to a wet grinding procedure by using a solid medium-agitation type grinder in which the cellulose particles are agitated and ground with solid medium particles into fine fibrous cellulose particles. The wet grinding procedure is carried out to an extent such that the resultant finely divided fibrous cellulose particles exhibit a water-retaining power of 150% or more, preferably 210% or more. The water-retaining power is determined in such a manner that a sample of a slurry of the finely divided fibrous cellulose particles in water is centrifugally hydroextracted at an acceleration of 3,000 G for 15 minutes, the weight A of the hydroextracted sample is measured, the hydroextracted sample was dried at a temperature of 105° C. for 5 hours or more, the weight B of the dried sample was measured, and the water-retaining power WRP of the finely divided fibrous cellulose particles was calculated in accordance with the equation (I):

$$WRP(\%) = (A - B)/B \times 100 \quad \text{(I)}$$

Preferably, the resultant finely divided fibrous cellulose particles exhibit a viscosity of 50 cP or more when suspended in a consistency of 2% by weight in water at room temperature to form an aqueous suspension thereof, and a suspension stability of 50% or more when suspended in a consistency of 0.5% by weight in water to form an aqueous suspension thereof.

The suspension stability SS of the finely divided fibrous cellulose particles is determined in such a manner that an aqueous suspension of the finely divided fibrous cellulose particles in a consistency of 0.5% by weight is placed in a measuring cylinder having a capacity of 500 ml, the volume $V_0$ of the aqueous suspension in the measuring cylinder is measured, the aqueous suspension is left in the measuring cylinder to stand at a temperature of 20° C. for one hour to allow the finely divided fibrous cellulose particles to settle and thus the aqueous suspension is separated into an upper clear layer free from the finely divided fibrous cellulose particles and a lower cloudy layer in which the finely divided fibrous cellulose particles are still suspended; the volume V of the resultant lower cloudy layer in the measuring cylinder is measured immediately after the one hour-leaving step, and then the suspension stability SS of the finely divided fibrous cellulose particles is calculated in accordance with the equation (II):

$$SS(\%)=V/V_0\times 100 \quad \text{(II)}$$

The cellulose particles usable for the method of the present invention can be selected from bleached and unbleached hard and soft wood pulps, dissolved pulps, wasted paper pulps, cotton fibers, and cellulose powders.

The starting cellulose particles in the form of fibers preferably have a thickness of 20 to 100 μm and, an average length of 700 μm or more. In the method of the present invention, the cellulose powders are preferably prepared by mechanically grinding cellulose fibers, for example, pulp fibers, or by chemically dividing the cellulose fibers, or by a combination of the mechanical grinding and the chemical dividing procedures.

The mechanical grinding can be effected by using a roll crusher, a coarse crushing cutter, or a high speed impact crusher. The mechanically ground cellulose powders are available, for example, under the trademark of Pulp Flock from Sanyokokusaku Pulp Co., the trademark of Cell Flock PB from Georgia Pacific Co., and the trademark of Cellulose Powder B from Lettenmayer Brother Co.

The chemical dividing can be effected by treating cellulose fibers with a mineral acid such as sulfuric acid or hydrochloric acid to dissolve the amorphous portion of the cellulose fibers. The chemical divided cellulose powders are available, for example, under the trademark of Avicell from Asahi Kasei Kogyo K. K.

The combination of the mechanical grinding and the chemical dividing can be carried out by chemically treating cellulose fibers with a mineral acid and then mechanically grinding the chemically treated cellulose powder. This type of cellulose powders is available, for example, under the trademark of KC Flock from Sanyokokusaku Pulp Co., and Solka Flock from James Riner Co. The cellulose powders usable for the method of the present invention are not limited to those mentioned above.

The cellulose powders usable for the grinding step are not limited to those having a specific form, and thus may be in the form of spheres, rods, bars, or short fibers or an amorphous shape. Preferably, the cellulose particles in the powder are in the form of spheres or grains, because the resultant aqueous suspension containing the cellulose spheres or pellets is easily conveyed by flowing. Also, the cellulose particles in the powder preferably have an average size of 500 μm or less, because the aqueous suspension containing the cellulose particles having the above-mentioned size can be easily conveyed. There is no lower limit of the average size of the cellulose particles in the powder.

In the method of the present invention, the cellulose particles are suspended in a liquid not reactive to the cellulose particles to provide a slurry. The suspending liquid preferably consists essentially of water. Nevertheless, the suspending liquid may consist of at least one organic liquid compound that is not chemically reactive to the cellulose particles and has a flowing property sufficient for serving as a carrier for the cellulose particles. The liquid is preferably selected from the group consisting of lower monohydric alcohols, for example, methyl alcohol, and ethyl alcohol, ethylene glycol and glycerol.

The suspending liquid may be a mixture of water with at least one of the above-mentioned organic liquid compounds.

The cellulose particle slurry is fed to a solid medium-agitation type grinder.

The solid medium-agitation type grinder usable for the present invention comprises a fixed vessel and an agitator fixed in the vessel. The agitator can be rotated at a high speed. The vessel is filled with solid medium particles. When the agitator is driven at a high speed, the solid medium particles are vigorously agitated in the vessel. When a slurry of cellulose particles is fed in the grinder, a shearing force, cutting force and frictional force generated by the agitated solid medium particles are applied to the cellulose particles to finely divide same. This solid medium-agitation type grinder has a history of about 60 years and is the grinder most capable of continuously pulverizing fine particles having a size less than 1 μm.

This type of grinder can be classified as follows.

1) Tower type grinder (tower mill) that comprises a large scale cylindrical vessel and a screw type agitator inserted into the cylindrical vessel along the longitudinal axis of the vessel. The grinding operation of this grinder is carried out by utilizing the gravity.

2) Vessel type grinder (aquamizer) comprising a bowl-shaped vessel and a rotary agitator vertically arranged in the vessel.

3) Flow cylinder type grinder (sand grinder, Dyno mill, ultravisco mill) comprising a cylinder-shaped container and an agitator having a shaft extending along the longitudinal axis of the cylinder and a plurality of discs or pins extending outward from the shaft. In this grinder, the material to be ground is extruded in the direction of the agitator shaft.

4) Annular type grinder (Coball mill, Diamond fine mill) comprising rotary double cylinders arranged coaxially with each other.

The method of the present invention can be effected by using any one of the above-mentioned grinders. However, the grinder should be selected in consideration of the size of the cellulose particles to be ground and the size of the solid medium particles (beads) in the grinder.

The flow cylinder type grinders (for example, sand grinders, Dyno mills and ultravisco mills), and the annular type grinders (for example, diamond fine mills) can be continuously operated and thus are preferable for the method of the present invention. Particularly, the Dyno mill is a horizontal type and thus in this mill, a slurry containing the cellulose particles can be supplied downward through an inlet located at an upper end of the horizontal cylinder, whereas in a sand grinder which is of a vertical type, the cellulose particle slurry must be fed upward through an inlet located in the bottom of a vertical cylinder. The downward feed of the cellulose particle slurry is advantageous in that even when the cellulose particles are large or are in the form of fibers, the slurry can be smoothly fed without blocking. Also, the Dyno mill is advantageous in that the width of outlet gap located in the opposite end of the horizontal cylinder is adjustable and thus can be easily adjusted as desired in consideration of the size of the cellulose particles to be ground and the size of the ground cellulose particles.

FIG. 1 shows a cross-sectional view of a Dyno mill. In FIG. 1, the Dyno mill 1 comprises a horizontal cylinder 2 in which a grinding chamber 3 is formed, and an agitator 4 having a rotary shaft 5 inserted into the grinding chamber 3 along a longitudinal axis of the cylinder 2, and a plurality of agitating discs 6 extending outward from the shaft 5. The cylinder 2 is provided with a cooling jacket 7, a cooling water inlet 8 and a cooling water outlet 9. The grinding chamber 3 is filled by solid medium particles (not shown in FIG. 1) for grinding. Also, an inlet 10 for a cellulose particle slurry is arranged in an upper end of the cylinder 2 and an outlet 11 is arranged at the opposite upper end of the cylinder 2. The outlet 11 is connected to the grinding chamber through a gap 12. This gap 12 allows only the resultant finely divided fibrous cellulose particle suspension to pass therethrough, but does not allow the grinding solid medium particles to pass.

In the operation of the mill, a suspension of cellulose particles in a liquid is fed into the grinding chamber 3 through the inlet 10. When the agitator is rotated at a high speed, the cellulose particle suspension is vigorously agitated together with the grinding solid medium particles by the agitating discs 5. During the agitation, a shearing force, frictional force and cutting force generated by the grinding solid medium particles are applied to the cellulose particles. Until the cellulose particle dispersion reaches the gap 12, the cellulose particles are converted to finely divided fibrous cellulose particles. Then the resultant suspension of the finely divided fibrous cellulose particles are discharged through the gap 12 and the outlet 11.

During the grinding operation, the cylinder 2 and the content within the cylinder 2 are heated by frictional heat. Therefore, the cylinder 2 and content within the cylinder 2 are cooled by pumping cooling water through the cooling gasket 7. The cooling water is fed into the cooling gasket 7 through the inlet 8 and discharged to the outside through the outlet 9.

In the method of the present invention, the agitator in the grinder is revolved usually at a high speed. The peripheral speed of the agitator is variable depending on the size and performance thereof, and usually in the range of from 3 to 20 m/sec. When the peripheral speed is less than 3 m/sec, it needs an excessive amount of time to obtain the desired finely divided fibrous cellulose particles and thus it is not economical.

The type and size of the grinding solid medium particles are chosen in consideration of the economical effect, and discoloration of the resultant product owing to friction and abrasion among the grinding solid medium particles or between the inside surface of the cylinder and the grinding solid medium particles. Usually, the solid medium particles are selected from glass beads, alumina beads, zirconia beads and zircone beads, which exhibit a satisfactory economical effect and substantially no discoloration. Also, steel beads and titania beads are usable as the solid medium particles.

Preferably, the solid medium particles have an average diameter of from 0.1 mm to 6 mm, more preferably from 0.5 mm to 2 mm.

The type and size of the solid medium particles, the rotation number of the grinder and the consistency of the cellulose particle in the suspension are variable depending on the type and size of the starting cellulose particles and the expected size and performance of the resultant finely divided fibrous cellulose particles.

The amount of the solid medium particles to be filled in the grinder is set forth in consideration of the grinding efficiency, the wear of the solid medium particles per se and the inside surface of the cylinder, and the driving load necessary to operate the grinder. Namely, each grinder should be filled by the solid medium particles at an optimum packing. The grinding efficiency can be increased by increasing the packing of the solid medium particles. However, the increased packing sometimes results in undesirably increased wear of the solid medium particles per se and the inside surface of the cylinder.

Usually, the solid medium particles are packed at a packing of 50% to 90% by volume in the grinding chamber.

In the method of the present invention, the consistency of the starting cellulose particle suspension is variable depending on the property and the size of the starting cellulose particles. Usually, the consistency of the cellulose particles in the suspension is 40% by weight or less, preferably 0.5% to 20% by weight. When the consistency is more than 40% by weight, and particularly the starting cellulose particles have a large average size of, for example, more than 700 μm, the viscosity of the suspension rapidly raises during the grinding operation and thus the load applied to the grinder rapidly increases and the grinding efficiency is reduced. Also, if the consistency is less than 0.5% by weight, the amount of the grinded cellulose particles per unit time is too small, and if a suspension of the resultant fibrous cellulose particles having a consistency of 0.5% by weight or more is required, the resultant suspension must be concentrated. This concentration is costly and thus results in an economic disadvantage.

The grinding operation can be carried out batchwise or continuously. For example, in the continuous grinding operation, a plurality of grinders are arranged in series and the cellulose particles are coarsely divided in initial portions and then finely divided in final portions of the system.

The alteration in form of the cellulose particles during the grinding operation can be observed by using an optical microscope and a scanning type electron microscope.

As mentioned above, the size and shape of the starting cellulose particles are variable depending on the production method and grade thereof. Usually, the starting cellulose particles in the form of fibers have an average thickness of from 20 to 100 μm and an average length of 700 μm or less. The starting cellulose particles in the state of a powder are usually in the form of pillars or rods or flat short pipes that are sometimes twisted or bent, and have a size of 500 μm or less.

When the cellulose particle suspension is subjected to the grinding procedure, in the initial stage thereof, the structure of cellulose pulp cells are destroyed in the initial stage of the grinding procedure, for example, within several tens of seconds to several minutes from the start of the grinding procedure, which is variable depending on the consistency of the cellulose particles in the suspension, and thus the resultant divided cellulose particles take a form such that a plurality, several to several tens, of fibrils having a thickness of about 3 to 5 μm and a length of 0.55 mm or less are connected to each other or to non-ground particles (except that the microcrystalline cellulose particles do not have the above-mentioned form). In the final stage of the grinding procedure, the cellulose fibrils are finely divided into extremely fine fibrous cellulose particles having a thickness of 0.5 μm or less, preferably 0.15 μm or less, and an average length of 0.25 mm.

If the grinding procedure is excessively carried out, the fibrous cellulose particles are further finely divided, and thus converted to short fibrous or rod-shaped particles having a size of from 0.1 μm to several tens of μm. These formed fine cellulose particles exhibit an extremely enhanced suspension stability. However, they are difficult to entangle with each other, and therefore the viscosity of the resultant suspension is undesirably lowered. Also, the individual cellulose particles are separated from each other, and thus networks or flocks of the cellulose particles disappear. This phenomenon results in a reduction in the amount of water or liquid retained by the networks or flocks, and thus the water-retaining power of the resultant finely divided fibrous cellulose particles are undesirably reduced.

The reductions in the viscosity and in the water-retaining power are formed when the microcrystalline cellulose particles having a primary particle size of about 1 μm are ground. Namely, when the microcrystalline cellulose particles are pulverized, the resultant fine particles are in the form of short fibrils or rods that cannot be entangled with each other to form networks or flocks, and therefore exhibit a relatively low water-retaining power and viscosity.

As mentioned above, the grinding procedure applied to the cellulose particles by using the solid medium-agitation type grinder causes the specific surface area of the cellulose particles to increase and thus the number of hydroxide groups of the cellulose molecules exposed to the outside are increased. The hydroxide groups exhibit a high affinity to water. The increase in the number of the hydroxide groups results in increases in the viscosity and in the water-retaining power of the fibrous cellulose particles, and causes the suspension stability of the fibrous cellulose particles to be enhanced.

In the method of the present invention, the extent of the grinding procedure can be controlled by adjusting the water-retaining power of the resultant finely divided fibrous cellulose particles to a level of 150% or more, preferably 210% or more, more preferably 300% or more.

Also, it is preferable that the viscosity and the suspension stability of the resultant finely divided fibrous cellulose particles are controlled to levels of 50 cP or more, more preferably 500 cP or more, in a 2 weight % aqueous suspension thereof, and of 50% or more, more preferably 90% or more, is a 0.5 weight % aqueous suspension thereof, respectively.

The viscosity is determined by a customary method, for example, by using a viscometer, which is available under the trademark of DVL-B type Viscometer, from Tokyo Keiki Co., and in which a rotor No. 2 is employed at a temperature of 20° C. with a rotor rotation of 12 r.p.m.

The suspension stability is determined by the method afore-mentioned.

Also, the water-retaining power is determined by the method afore-mentioned. In the measurement of the water-retaining power, if the sample of the finely divided fibrous cellulose particle suspension contains a very large amount of water, it is preferable that a portion of water be removed, for example, by filtration, before the centrifugal hydroextraction. By this previous removal of water, the water content of the suspension is reduced to a level of about 85% to 95% by weight.

The starting aqueous suspension containing 2% by weight of cellulose particles to be subjected to the grinding procedure has a viscosity similar to that of water. The aqueous suspension containing 0.5% by weight of cellulose particles has a suspension stability of 5% or less and a water-retaining power of 20 to 80%.

When the method of the present invention is applied to the cellulose particles, the resultant finely divided fibrous cellulose particles exhibit a very high water-retaining power of 150% or more, preferably 210%, more preferably 300%.

Also, the 2 weight % aqueous suspension of the resultant finely divided fibrous cellulose particles exhibits a viscosity of 50 cP or more, sometimes 2000 cP or more, and a 0.5 weight % aqueous suspension of the resultant finely divided fibrous cellulose particles exhibits a very high suspension stability of 50% or more.

The finely divided fibrous cellulose particles produced in accordance with the method of the present invention exhibits a specific performance such that when the finely divided fibrous cellulose particles are suspended in a high consistency, for example, 3% by weight or more, in water, the resultant aqueous suspension exhibits a form-retaining property in spite of the fact that the suspension contains a certain amount of water.

EXAMPLES

The present invention will be further explained by the following examples.

EXAMPLE 1

A bleached soft wood kraft pulp was suspended in a consistency of 0.8%, 1.5%, 4%, 8% or 10% by weight in water, and 120 g of the resultant aqueous suspension was subjected to a batchwise wet grinding procedure by using a six cylinder type sand grinder made by Aimex Corp., having a capacity of 300 ml, and containing 125 ml of glass beads with an average diameter of 0.7 mm, as solid medium particles.

The grinding procedure was carried out at an agitator rotation of 2000 rpm, while cooling the content of the grinder to a temperature of about 20° C.

The thickness of the resultant fibrous cellulose particles was measured by observation by a scanning type electron microscope. Also, the water-retaining power of the resultant fibrous cellulose particles was measured.

Also, the average length of the resultant fibrous cellulose particles was measured by using a fiber length tester available under the trademark of Fiber Length Tester FS-200, from Kajaani Co., Finland.

Figure 2:
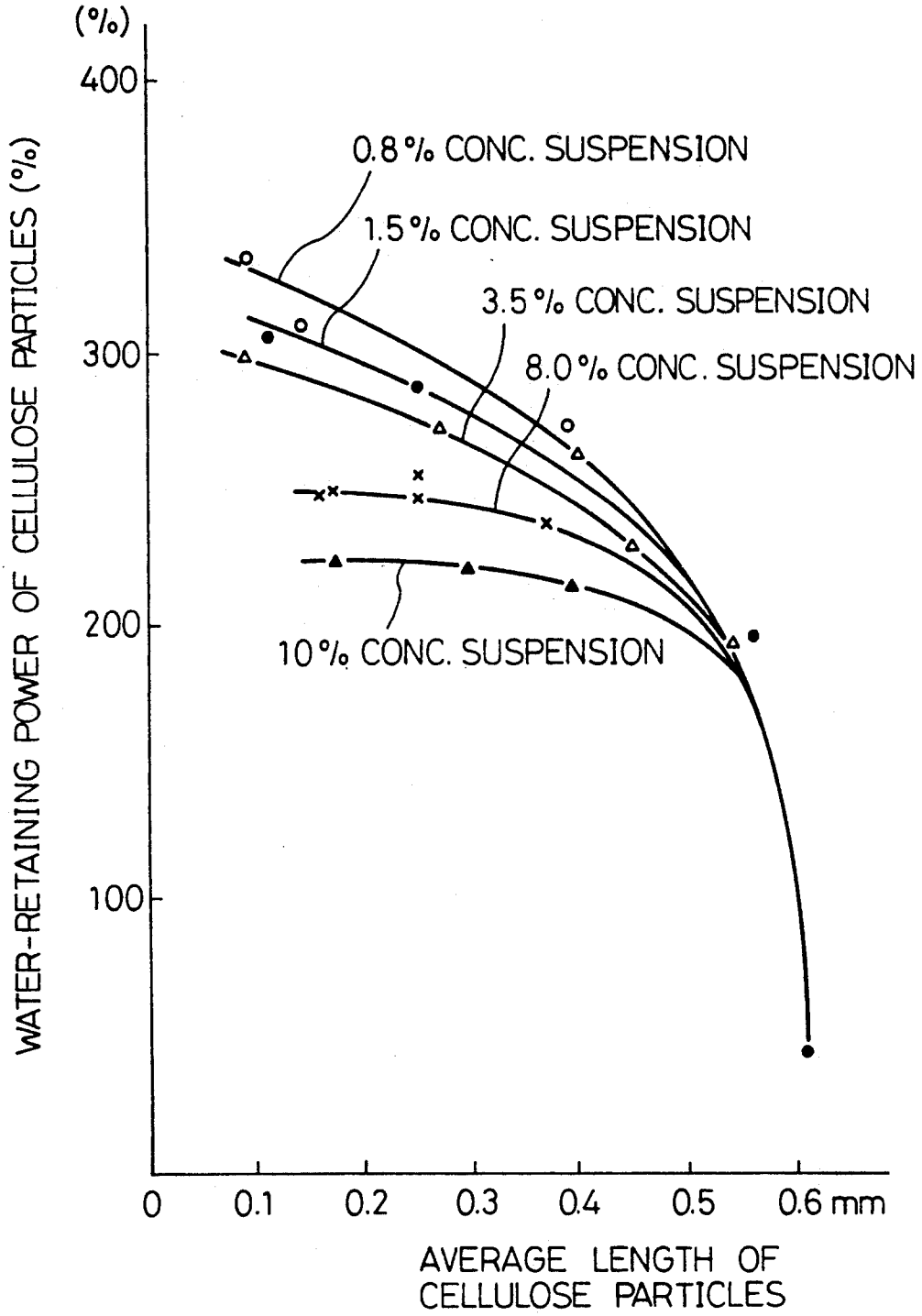
FIG. 2 is a graph showing relationships of the consistency of aqueous cellulose particle suspension and the average fiber length and water-retaining power of the finely divided fibrous cellulose particles of Example 1.

FIG. 2 shows relationships between the average length and the water-retaining power of the resultant fibrous cellulose particles, in consistencies of 0.8, 1.5, 4, 8 and 10% by weight.

Table 1 shows relationships between the grinding time and the average fiber length, the thickness and the water-retaining power of the resultant fibrous cellulose particles, prepared in a suspension consistency of 1.5% by weight.

TABLE 1

| Grinding time (min) | Average fiber length (mm) | Fiber thickness (μm) | Water-retaining power (%) |
|---|---|---|---|
| 0 | 0.61 | 20 | 44 |
| 30 | 0.50 | — | 227 |
| 40 | 0.25 | 1-2 | 288 |
| 60 | 0.12 | — | 306 |
| 90 | 0.10 | 0.05–0.2 | 312 |

TABLE 1-continued

| Grinding time (min) | Average fiber length (mm) | Fiber thickness (μm) | Water-retaining power (%) |
|---|---|---|---|
| 120 | 0.09 | — | 321 |

Table 1 shows that the extension of the grinding time results in a reduction in the average fiber length and in an increase in the water-retaining power of the resultant fibrous cellulose particles.

Also, the water-retaining power of the resultant fibrous cellulose particles that increased with a decrease in the suspension consistency depending upon the average fiber length of the resultant fibrous cellulose particles are constant.

EXAMPLE 2

A bleached soft wood kraft pulp was suspended in a consistency of 3% by weight in water. The resultant aqueous pulp suspension in an amount of 120 g was subjected to a grinding procedure. This grinding procedure was carried out batchwise by using a six cylinder type sand grinder having a capacity of 300 ml. In this grinder, 125 ml of glass beads having an average size of 1 mm were contained as solid medium particles at a packing of 50% by volume, and the agitator is operated at a rotation of 1500 rpm, while maintaining the temperature of the content in the grinder by circulating cooling water through a cooling jacket at about 60° C., for a grinding time of one hour, 2 hours or 3 hours.

The resultant finely divided fibrous cellulose particles exhibited the water-retaining powers as shown in Table 2.

TABLE 2

| Grinding time (hr) | Water-retaining power (%) |
|---|---|
| 0 | 51 |
| 1 | 212 |
| 2 | 244 |
| 3 | 325 |

Table 2 clearly shows that the water-retaining power of the resultant finely divided fibrous cellulose particles increased with an increase in the grinding time, and after a 3 hour grinding procedure, the resultant fibrous cellulose particles exhibited an extremely high water-retaining power of 325%.

EXAMPLE 3

Finely divided fibrous cellulose particles were prepared by the same procedures as in Example 2, except that the bleached soft wood kraft pulp was replaced by a bleached soft wood sulfite pulp and the rotation of the agitator was changed from 1200 rpm to 1500 rpm.

The resultant fibrous cellulose particles exhibited the water-retaining power as shown in Table 3.

TABLE 3

| Grinding time (hr) | Water-retaining power (%) |
|---|---|
| 0 | 72 |
| 1 | 232 |
| 2 | 288 |
| 3 | 332 |

Table 3 clearly shows that the water-retaining power of the resultant finely divided fibrous cellulose particles increased with an increase in the grinding time, and the 3 hour grinding procedure resulted in a very high water-retaining power of 332% of the resultant fibrous cellulose particles.

EXAMPLE 4

A mechanical pulp (mechanically ground wood pulp under pressure) was suspended in a consistency of 2% by weight in water.

The aqueous suspension in an amount of 120 g was fed to a six cylinder-type sand grinder containing, as solid medium particles, 125 ml of alumina beads with an average size of 0.5 mm at a packing of 50% by volume, and a grinding procedure was carried out batchwise by operating an agitator at a rotation of 2000 rpm for 45 or 90 minutes, while cooling the content in the grinder to a temperature of 20° C. by circulating cooling water through a cooling jacket.

The resultant fibrous cellulose particles had the water-retaining power as shown in Table 4.

TABLE 4

| Grinding time (min) | Water-retaining power (%) |
|---|---|
| 0 | 145 |
| 45 | 232 |
| 90 | 249 |

Table 4 shows that the water-retaining power of the resultant fibrous cellulose particles increased with an increase in the grinding time.

EXAMPLE 5

The same procedures as in Example 4 were carried out except that the mechanical pulp was replaced by a wasted paper pulp.

The resultant fibrous cellulose particles had the water-retaining power as shown in Table 5.

TABLE 5

| Grinding time (min) | Water-retaining power (%) |
|---|---|
| 0 | 111 |
| 45 | 263 |
| 95 | 310 |

Table 5 shows that the water-retaining power of the resultant fibrous cellulose particles increased with an extension of the grinding time.

EXAMPLE 6

A cotton linter was suspended in a consistency of 2% by weight in water.

The resultant aqueous suspension was fed in an amount of 120 g to a six cylinder type sand grinder containing 125 ml of zirconia beads with an average size of 0.5 mm. The sand grinder was driven batchwise by operating an agitator at a rotation of 2000 rpm while cooling the content in the grinder to a temperature of 20° C. for 45 or 90 minutes.

The resultant fibrous cellulose particles had the water-retaining power as shown in Table 6.

TABLE 6

| Grinding time (min) | Water-retaining power (%) |
|---|---|
| 0 | 78 |
| 45 | 254 |
| 90 | 303 |

EXAMPLE 7

A bleached soft wood kraft pulp was suspended in a consistency of 1.5% in water, and 1600 ml of the resultant suspension was continuously fed to an ultravisco mill having a capacity of 2000 ml, and available under the trademark of Ultravisco Mill UVM-2 from Aimex Corp., at a flow rate of 500 ml/min. The grinder contained 1200 ml of glass beads having an average diameter of 0.7 mm. The grinding temperature was maintained at about 15° C. by pumping cooling water through a jacket of the grinder.

The resultant suspension discharged from the grinder was recycled to the grinder in 5 cycles, 10 cycles or 15 cycles.

Table 7 shows the relationship between the grinding cycle number and the water-retaining power of the resultant fibrous cellulose particles.

TABLE 7

| Grinding cycle number | Water-retaining power (%) |
|---|---|
| 0 | 44 |
| 5 | 215 |
| 10 | 285 |
| 15 | 314 |

Table 7 shows that the water-retaining power of the resultant fibrous cellulose particles increased with an increase in the grinding cycle number.

Also, it was confirmed, that the repeated grinding procedures created no blocking of the grinder.

EXAMPLE 8

A bleached soft wood kraft pulp was preliminarily beaten by a beater to make the length of the pulp fibers short. The beaten pulp was suspended in a consistency of 3% by weight in water and 2000 ml of the resultant aqueous suspension was continuously fed at a flow rate of 400 ml/min to a Dyno mill having a capacity of 1500 ml and available under the trademark of Dyno Mill Type KDL-PILOT, from Shinmaru Enterprises Co., while maintaining the temperature of the content in the grinder at about 15° C. by recycling cooling water.

The grinder contained, as solid medium particles, 1200 ml of glass beads with an average diameter of 1 mm.

The above-mentioned grinding procedures were repeated at 1, 4, 6, 9 or 12 cycles.

The resultant fibrous cellulose particles had the water-retaining power as shown in Table 8.

TABLE 8

| Grinding cycle number | Water-retaining power (%) |
|---|---|
| 0 | 125 |
| 1 | 273 |
| 4 | 286 |
| 6 | 305 |
| 9 | 304 |
| 12 | 310 |

Table 8 shows that the water-retaining power of the resultant fibrous cellulose particles increased with an increase in the grinding cycle number.

Also, during the 12 grinding cycles, no blocking of the grinder was found.

EXAMPLE 9

A bleached hard wood pulp was suspended in a consistency of 1.5% in water and 500 ml of the resultant suspension was fed to a diamond fine mill having a capacity of 1300 ml, available under the trademark of Diamond Fine Mill MD-13, from Mitsubishi Heavy Industries Co., and containing 995 ml of glass beads with an average diameter of 1 mm.

The wet grinding procedures were carried out batchwise by driving an agitator at a rotation of 1400 rpm, for 30, 60 or 90 minutes.

Table 9 shows a relationship between the grinding time and the water-retaining power of the resultant fibrous cellulose particles.

TABLE 9

| Grinding time (min) | Water-retaining power (%) |
|---|---|
| 0 | 44 |
| 30 | 280 |
| 60 | 291 |
| 90 | 299 |

Table 9 shows that the extension of the grinding time results in an increase in the water-retaining power of the resultant fibrous cellulose particles.

EXAMPLE 10

A bleached hard wood kraft pulp in an amount of 1.8 g was suspended in 120 ml of methyl alcohol, and the resultant pulp suspension was fed to a six cylinder type sand grinder having a capacity of 300 ml and containing 120 ml of glass beads with an average diameter of 0.7 mm.

The grinding procedures were carried out batchwise at a temperature of 5° C. while operating an agitator at a rotation of 2000 rpm, for 30 or 90 minutes.

Table 10 shows a relationship between the grinding time and the water-retaining power of the resultant fibrous cellulose particles.

The resultant fibrous cellulose particles are collected from the suspension by a filteration, washed with water and then subjected to a measurement of the water-retaining power thereof.

TABLE 10

| Grinding time (min) | Water-retaining power (%) |
|---|---|
| 0 | 53 |
| 30 | 236 |
| 90 | 316 |

Table 10 shows that even when methyl alcohol was used as a suspending medium, the water-retaining power of the resultant fibrous cellulose particles was satisfactory and was increased with an extension of the grinding time.

EXAMPLE 11

The same procedures as in Example 10 were carried out except that the methyl alcohol was replaced by 120 ml of glycerol and the grinding time was 30, 90 or 120 minutes.

The results are shown in Table 11.

TABLE 11

| Grinding time (min) | Water-retaining power (%) |
|---|---|
| 0 | 53 |
| 30 | 215 |
| 90 | 363 |
| 120 | 325 |

Table 11 shows that even when glycerol was employed as a suspending medium, the resultant fibrous cellulose particles exhibit a satisfactory water-retaining power that increased with an extension of the grinding time.

EXAMPLE 12

The cellulose particles, which were produced by mechanically grinding soft pulp fiber parenchyma cells having a relatively low mechanical strength, are available under the trademark of Pulp Flock W-4, from Sanyokokusaku Pulp Co., and have a particle size of 30 to 80 μm, were suspended in a consistency of 9.0% by weight in water.

The aqueous suspension in an amount of 120 g was fed to a six cylinder type sand grinder having a capacity of 300 ml and containing 125 ml of glass beads with an average diameter of 0.7 mm.

The wet grinding procedure was carried out batchwise by operating an agitator at a rotation of 2000 rpm, while cooling the content in the grinder to a temperature of about 20° C. by circulating a cooling water through a cooling jacket equipped around the grinder.

The resultant fibrous cellulose particles had the viscosity in a 2 weight % aqueous suspension, the suspension stability in a 0.5 weight % aqueous suspension, and the water-retaining power as shown in Table 12.

TABLE 12

| Grinding time (min) | Viscosity (2% con.)(cP) | Suspension stability (0.5% con.)(%) | Water-retaining power (%) |
|---|---|---|---|
| 0 | 2 | 5 | 20 |
| 2 | 67 | 19 | 170 |
| 10 | 840 | 97 | 220 |
| 40 | 1,170 | 98 | 279 |
| 90 | 2,348 | 100 | 295 |

Table 12 shows that the viscosity, the suspension stability and the water-retaining power of the resultant fibrous cellulose particles was enhanced with an increase in the grinding time.

Figure 3:
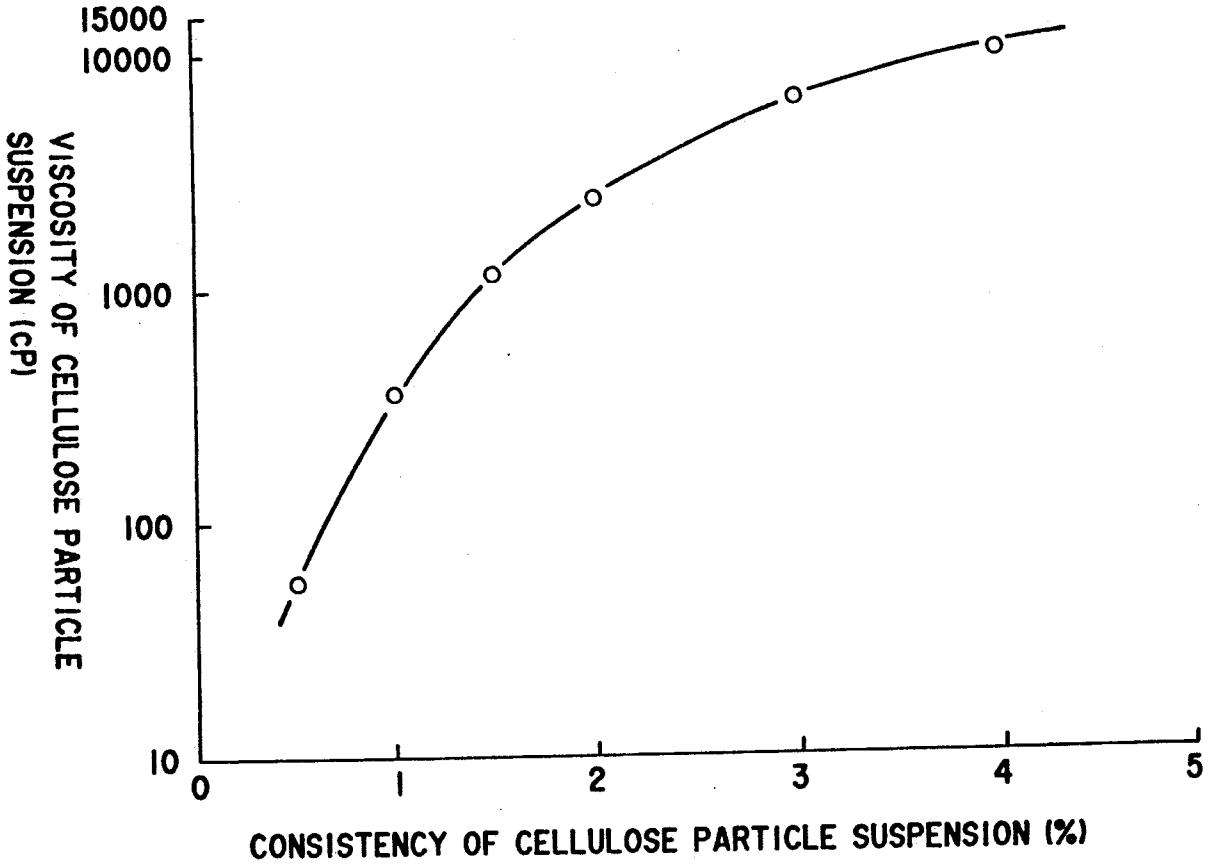
FIG. 3 is a graph showing a relationship between the consistency of finely divided fibrous cellulose particles suspended in water and the viscosity of the aqueous suspension of Example 12.

FIG. 3 shows a relationship between the consistency of the starting cellulose particles in the aqueous suspension and the viscosity of the resultant suspension.

In the measurement of the viscosities of the suspensions having a consistency of 3% by weight or more, a rotor No. 4 was used in place of the rotor No. 2.

FIG. 3 shows that the viscosity of the 4 weight % aqueous suspension is more than 2000 cP, and thus this aqueous suspension exhibited an enhanced form-retaining property.

EXAMPLE 13

Cellulose particles, which were produced by lightly treating wood pulp fibers with a mineral acid to reduce the mechanical strength thereof, and then mechanically grinding the acid treated pulp fibers, was available under the trademark of KC Flock 400, from Sanyokokusaku Pulp Co., and had a particle size of from 30 to 80 μm, were suspended in a consistency of 6.0% by weight in water.

The cellulose particles in an amount of 120 g were subjected to the same grinding procedures as in Example 12.

The test results are shown in Table 13.

TABLE 13

| Grinding time (min) | Viscosity (cP) (2% conc.) | Suspension stability (%) (0.5% conc.) | Water-retaining power (%) |
|---|---|---|---|
| 0 | 2 | 4 | 67 |
| 10 | 974 | 99 | 297 |
| 40 | 939 | 99 | 308 |
| 90 | 934 | 100 | 294 |

Table 13 clearly shows that by the grinding operation of only 10 minutes, the viscosity reached 974 cP, the suspension stability raised to 99% and the water-retaining power was increased to 297%.

The further extension of the grinding time from 10 minutes was not effective enough to enhance the viscosity, the suspension stability and the water-retaining power of the resultant finely divided fibrous cellulose particles.

EXAMPLE 14

Microcrystalline cellulose particles, which were produced by dissolving away amorphous portions of wood pulp particles by a mineral acid, was available under the trademark of Avicel from Asahi Kasei Kogyo K. K. and had a particle size of several μm to about 40 μm, were suspended in a consistency of 6% by weight in water.

The cellulose particles were subjected in an amount of 120 g to the same grinding procedures as in Example 12.

The resultant finely divided fibrous cellulose particles had the properties as shown in Table 14.

TABLE 14

| Grinding time (min) | Viscosity cP (2% conc.) | Suspension stability (%) (0.5% conc.) | Water-retaining power (%) |
|---|---|---|---|
| 0 | 2 | 3 | 79 |
| 10 | 78 | 70 | 202 |
| 40 | 201 | 95 | 241 |
| 90 | 329 | 100 | 244 |

Table 14 shows that the extension of the grinding time resulted in increases in the viscosity, in the suspension stability and in the water-retaining power.

The resultant fibrous cellulose particles obtained from the microcrystalline cellulose particles (Avicel) exhibited a relatively lower viscosity and water-retaining power in comparison with those obtained from Pulp Flock (Example 12) and KC Flock (Example 13). Also, to obtain a satisfactorily high suspension stability of the fibrous cellulose particles from the microcrystalline cellulose particles, a relatively longer grinding time in comparison with Examples 12 and 13 was necessary.

EXAMPLE 15

The same cellulose particles (Pulp Flock W-4) as in Example 12 were suspended in a consistency of 3% by weight in water, and 4000 ml of the resultant aqueous suspension was continuously fed to a solid medium-agitation type grinder available under the trademark of Dyno Mill Type KDL-PILOT, from Shinmaru Enterprises Co., in a flow rate of 350 ml/min.

The grinder had a capacity of 1500 ml, contained 1200 ml of glass beads with an average diameter of 1 mm.

The grinding temperature was maintained at a level of about 20° C. by circulating cooling water through a cooling jacket.

The treated aqueous suspension was discharged from the grinder. The discharged suspension was recycled to the grinder. This recycling was repeated 1, 2, 3, 4 and 5 times.

The resultant finely divided fibrous cellulose particles had the viscosity, the suspension stability and the water-retaining power as shown in Table 15.

TABLE 15

| Grinding cycle number | Viscosity (cP) (2% conc.) | Suspension stability (%) (0.5% conc.) | Water-retaining power (%) |
|---|---|---|---|
| 0 | 2 | 5 | 20 |
| 1 | 548 | 97 | 269 |
| 2 | 1,097 | 97 | 299 |
| 3 | 1,570 | 98 | 289 |
| 4 | 1,697 | 99 | 286 |
| 5 | 1,517 | 99 | 278 |

Table 14 shows that by one grinding cycle, the resultant fibrous cellulose particles exhibited a satisfactory viscosity, suspension stability and water-retaining power. The increase in the grinding cycle results in a further increase in the viscosity, suspension stability and water-retaining power.

We claim:

1. A method of producing finely divided fibrous cellulose particles, comprising the steps of:

suspending cellulose particles in a liquid not chemically reactive to the cellulose particles to provide a cellulose particle slurry;

treating the cellulose particle slurry in a solid medium-agitation type grinder in which the cellulose particles are agitated and ground with solid medium particles to an extent such that the cellulose particles are finely divided into fine fibrous cellulose particles having a water-retaining power of at least 150%, determined by centrifugally hydroextracting a sample of a slurry of the resultant finely divided fibrous cellulose particles in water at an acceleration of 3,000 G for 15 minutes, measuring the weight of the hydroextracted sample, drying the hydroextracted sample at a temperature of 105° C. for at least 5 hours, measuring the weight of the dried sample, and calculating the water-retaining power of the finely divided fibrous cellulose particles in accordance with the equation ):

$$WRP(\%)=(A-B)/B\times 100 \quad \text{(I)}$$

wherein WRP represents the water-retaining power of the finely divided fibrous cellulose particles, A represents the weight of the hydroextracted sample, and B represents the weight of the dried sample.

2. The method as claimed in claim 1, wherein the starting cellulose particles are selected from the group consisting of cellulose fibers and cellulose powders.

3. The method as claimed in claim 1, wherein the starting cellulose particles are in the form of fibers having a thickness of 20 to 100 μm, and an average length of at most 700 μm.

4. The method as claimed in claim 1, wherein the starting cellulose particles are in the state of a powder and have a size of at most 500 μm.

5. The method as claimed in claim 1, wherein the resultant finely divided fibrous cellulose particles have a thickness of at most 5 μm and an average length of at most 550 μm.

6. The method as claimed in claim 1, wherein the solid medium particles in the grinder are selected from the group consisting of glass beads, alumina beads, zirconia beads, zircone beads, steel beads and titania beads each having an average diameter of from 0.1 mm to 6 mm.

7. The method as claimed in claim 1, wherein the solid medium-agitation type grinder is selected from the group consisting of tower type grinders, vessel type grinders, flow cylinder type grinders and annular type grinders.

8. The method as claimed in claim 1, wherein the water-retaining power of the resultant finely divided fibrous cellulose particles is at least 210%.

9. The method as claimed in claim 1, wherein the resultant finely divided fibrous cellulose particles exhibit a viscosity of at least 50 cP in a 2 weight % aqueous, suspension thereof, and a suspension stability of at least 50% in a 0.5 weight % aqueous suspension thereof, determined by placing the 0.5 weight % aqueous suspension in a 500 ml measuring cylinder, leaving the aqueous suspension to stand at a temperature of 20° C. for one hour to allow the finely divided fibrous cellulose particles to settle, and the aqueous suspension to be separated into an upper clear layer free from the finely divided fibrous cellulose particles and a lower cloudy layer in which the finely divided fibrous cellulose particles are still suspended, and calculating the suspension stability of the finely divided fibrous cellulose particles in accordance with the equation (II):

$$SS(\%)=V/V_0\times 100 \quad \text{(II)}$$

wherein SS represents the suspension stability of the finely divided fibrous cellulose particle in the aqueous suspension, $V_0$ represent the volume of the original aqueous suspension in the measuring cylinder, and V represents a volume of the resultant lower cloudy layer in the measuring cylinder just after the one hour-leaving step.

* * * * *